US006176346B1

(12) United States Patent
Wiener

(10) Patent No.: US 6,176,346 B1
(45) Date of Patent: Jan. 23, 2001

(54) NESTING SPEAKER ASSEMBLY

(76) Inventor: David Wiener, 10 Iron Canyon Ct., Park City, UT (US) 84060

( * ) Notice: Under 35 U.S.C. 154(b), the term of this patent shall be extended for 0 days.

(21) Appl. No.: 09/562,615

(22) Filed: May 1, 2000

(51) Int. Cl.[7] ..... A47B 81/06
(52) U.S. Cl. ..... 181/199
(58) Field of Search ..... 181/150, 199, 181/141, 198, 156

(56) References Cited

U.S. PATENT DOCUMENTS 2,036,832 * 4/1936 Scheldorf ..... 181/199
5,416,284 * 5/1995 Steele et al. ..... 181/199
5,550,926 * 8/1996 Tsao ..... 181/199

* cited by examiner

*Primary Examiner*—Khanh Dang
(74) *Attorney, Agent, or Firm*—David P. Gordon; David S. Jacobson; Thomas A Gallagher

(57) ABSTRACT

A nestable speaker assembly includes a plurality of speaker mounting elements, at least one speaker driver coupled to each of the speaker mounting elements, and a plurality of open-front enclosures coupled to the speaker mounting elements. The open-front enclosures have a first end and a second end and define cavities therebetween. The open-front enclosures taper from said first end to said second end. The first ends of the open-front enclosures substantially define openings into said cavities. When assembled, the speaker mounting element and the open-front enclosure substantially enclose the opening into the cavity. When disassembled, one of the plurality of open-front enclosures substantially nests within a cavity of another of the plurality of open-front enclosures. A plurality of speaker mounting elements containing speaker drivers may be stored within the cavity of the last of the plurality of open-front enclosures. According to a preferred aspect of the invention, the speaker mounting elements detachably coupled in a front to rear relation. Alternately or additionally, a pair of caps adapted to fit over the fronts and rears of the speaker mounting elements may be provided. Alternately, stacking structures defining channels and adapted to secure opposing sides of the speaker mounting elements which maintain them a distance apart in a front to back relation may be used.

27 Claims, 9 Drawing Sheets

NESTING SPEAKER ASSEMBLY

BACKGROUND OF THE INVENTION

1. Field of the Invention

This invention relates broadly to audio speakers. More particularly, this invention relates to lightweight, portable, nesting stereo speakers.

2. State of the Art

Sound quality is important in the design of sound reproducing systems, such as speakers used in concert halls, home stereo systems, and portable stereo systems. Further, size, shape, weight, and portability are also important. The size and shape and ultimate weight of the entire speaker system is often driven by the speaker sound quality requirements. Sound quality and other acoustical resonance related characteristics are enhanced by having an enclosed air volume behind the speaker driver. In general, the optimal size of the enclosure will depend on the size and specifications of the speaker driver. Generally, for space and weight constrained sound systems including boomboxes and portable stereos, the smaller speaker drivers are mounted within a relatively small housing or enclosure which provides less than ideal quality sound reproduction. To improve the sound quality, using a larger driver, and hence a larger enclosure, is preferable. For large speaker drivers i.e., those used for public address, concert, or stadium sound systems, optimal quality sound reproduction requires using relatively large high-fidelity speaker drivers and mounting them within relatively large enclosures. Toward this end, the large high-fidelity speaker drivers are generally mounted within large rectangular substantially hollow boxes formed from wood, pressed board, or hard plastic. Although such enclosures are quite sturdy, they are generally heavy, bulky, and cumbersome. Further, they often require great strength and effort to move and install, require sturdy supports to mount on speaker stands, and pose certain dangers when mounted overhead. Still further, the speaker drivers are quite generally delicate and easily damaged. When used in touring events, these large speaker systems can require numerous trucks to transport them from event to event and careful handling to protect them. When not in use, they require a large storage facility. Collapsible speaker enclosures have been designed which alleviate some of the bulkiness and difficulties related to storage and transport of these large speaker assemblies. However, the weight of the collapsible speaker assemblies remain the same whether in the extended or collapsed state. Further, many of the prior art collapsible speaker assemblies are complex to assemble and dismantle, having numerous parts which can be lost or damaged.

SUMMARY OF THE INVENTION

It is therefore an object of the invention to provide a portable speaker assembly which is lightweight, portable, and compact and which has good sound quality.

It is another object of the invention to provide a portable speaker assembly which requires minimal freight or storage volume yet which has a desirable air chamber volume behind the speaker.

It is a further object of the invention to provide a portable speaker assembly which is easily assemblable and disassemblable.

In accord with these objects, which will be discussed in detail below, a speaker assembly includes a speaker mounting element having a face defining a speaker driver mounting opening, and having two pair of opposing sides, at least one speaker driver mounted in the speaker driver mounting opening, and a hollow open-front enclosure, substantially defining a cavity, coupled to the speaker mounting element. The open-front enclosure is preferably shaped as a truncated polyhedron (e.g. a truncated pyramid) having a first end and a second end. The first end of the open-front enclosure substantially defines an opening into the cavity. The second end of the open-front enclosure is substantially closed. The speaker mounting element is shaped substantially similarly to the first end of the open-front enclosure.

According to both the first and second embodiments of the invention, either of the pair of opposing sides of the speaker mounting element and the first end of the open-front enclosure are provided with any of a variety of cooperating coupling structures such that the two may be detachably coupled. A securing device may also be secured about the structure to apply an inward pressure or force further coupling the speaker mounting element to the open-front enclosure. When assembled, the speaker mounting element and the open-front enclosure substantially enclose the cavity, which acts as a resonance air chamber behind the speaker driver. According to the invention, when disassembled, one open-front enclosure substantially nests within a cavity of another open-front enclosure.

According to a preferred aspect of the invention, the speaker mounting elements are adapted to be stacked and stored within a cavity of a nested open-front enclosure. To facilitate stacking and storing, edges of the front of the speaker mounting element are provided with a projection adapted to loosely engage a corresponding indentation in a terminal end of the sides of the speaker mounting elements. The couplings allow for safely stacking a plurality of speaker mounting elements in a front to rear relation without damaging speaker drivers contained therein. The plurality of stacked speaker mounting elements are then safely stored within the cavity of a first open-front enclosure. Alternately or additionally, a cap adapted to fit over the front face of a first of a plurality of speaker mounting elements and a rear of a second of a plurality of speaker mounting elements may be provided to maintain a first and a second of a plurality of speaker mounting elements in a front to back relation when stored within a cavity of an open-front enclosure. Alternately, a two piece stacking structure having a first piece and a second piece having a plurality of channels adapted to fit over opposing sides of a plurality of speaker mounting elements and maintain them a distance apart in a front to back relation is used to protect the speaker mounting elements and speaker drivers when stored within a cavity of an open-front enclosure.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
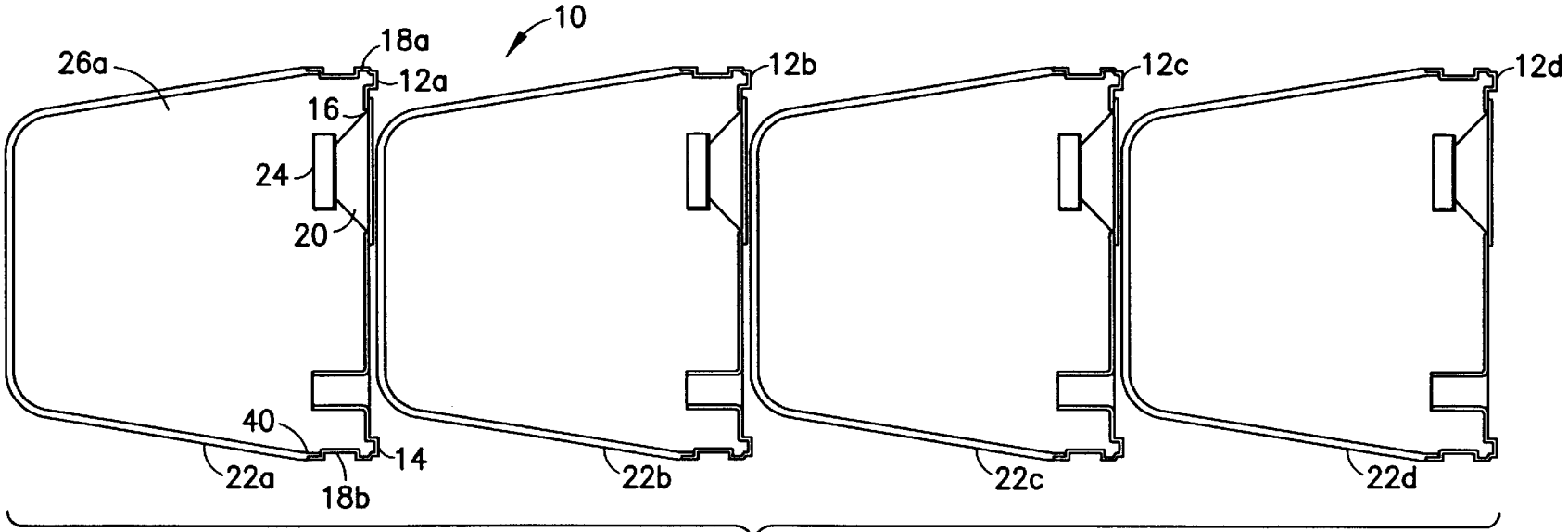
FIG. 1 is a cross-sectional view of a plurality of assembled nestable speaker assemblies according to a first embodiment of the invention.

Turning now to FIG. 1, a first embodiment of a nestable speaker assembly 10 includes a plurality of speaker mounting elements 12*a*–12*d* each having a face 14 defining a speaker mounting opening 16 and each having two opposing pair of sides 18*a*, 18*b* and 18*c*, 18*d* (shown in FIG. 2), a speaker driver 20 mounted in the speaker mounting opening 16, and a plurality of hollow open-front enclosures 22*a*–22*d* each coupled to one of the speaker mounting elements 12*a*–12*d*. According to the invention, one of the speaker mounting elements 12*a* is coupled to one of the open-front enclosures 22*a* such that a rear 24 of the speaker driver 20 is contained within the hollow open-front enclosure 22*a*. When coupled together, the speaker mounting element 12*a* and the open-front enclosure 22*a* forms an enclosure desirably defining an air chamber 26*a* behind the speaker driver 20.

Figure 2:
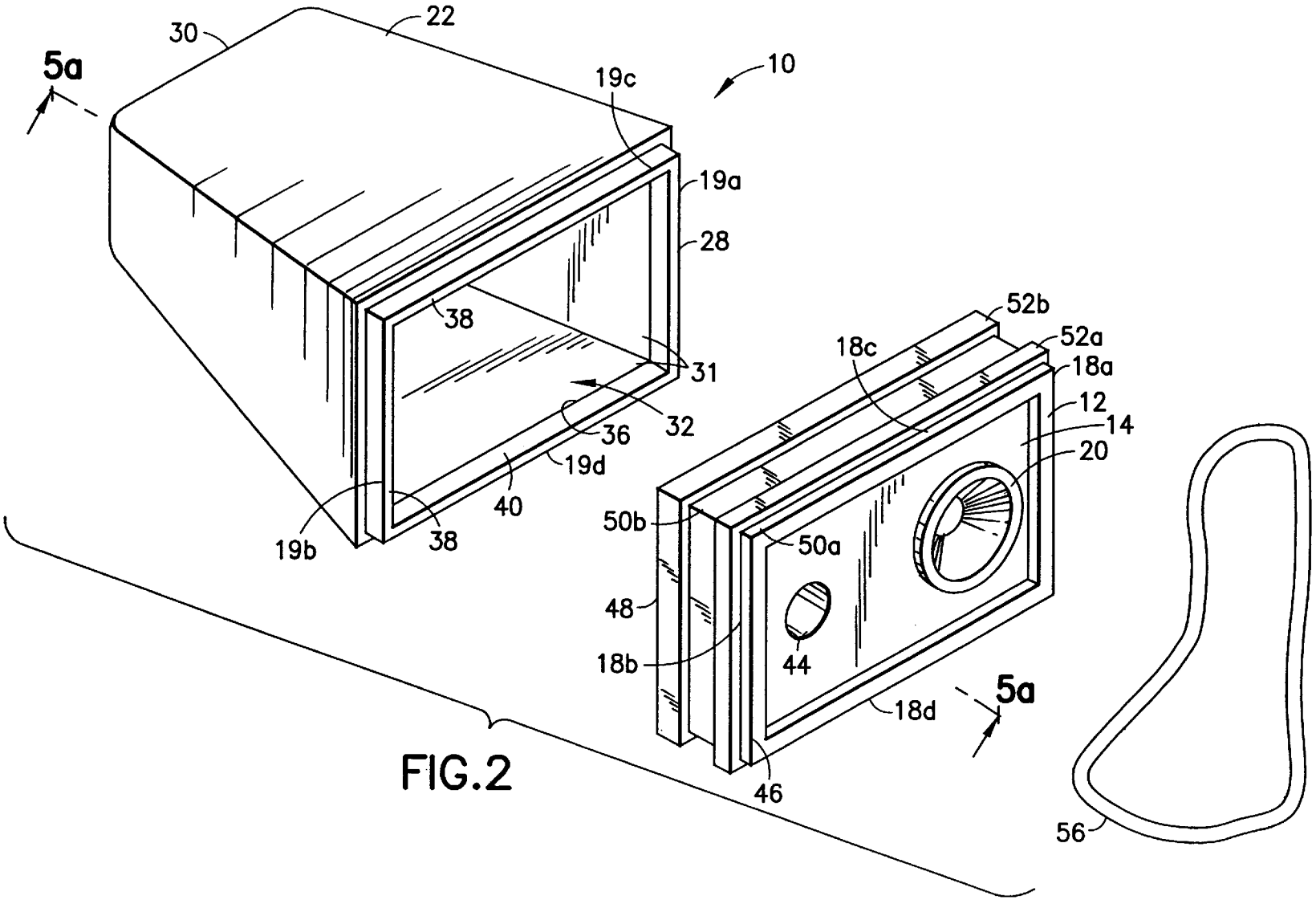
FIG. 2 is an exploded perspective view of a first embodiment of the speaker assembly according to the invention.
Figure 3:
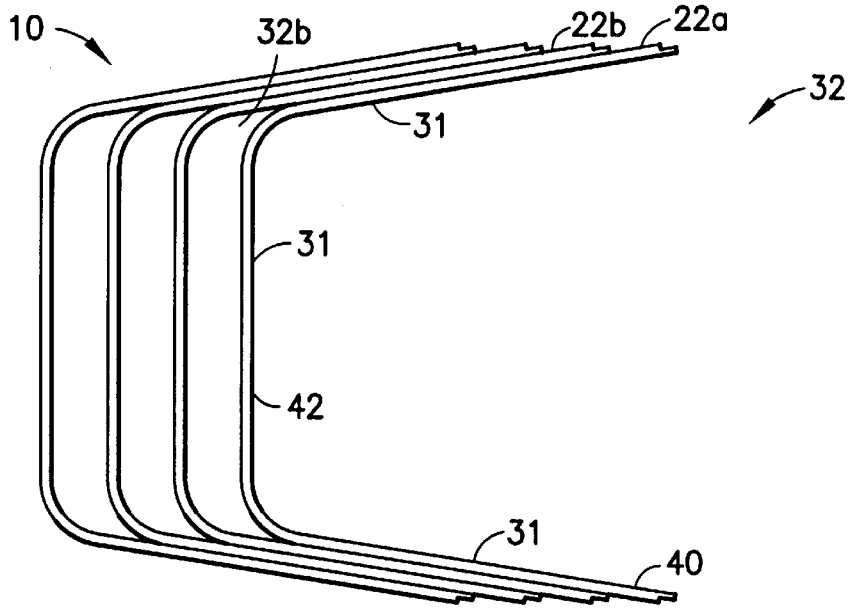
FIG. 3 is a cross-sectional view of the plurality of nestable speaker open-front enclosures of speaker assemblies of the first embodiment disassembled and nested according to the invention.
Figure 4:
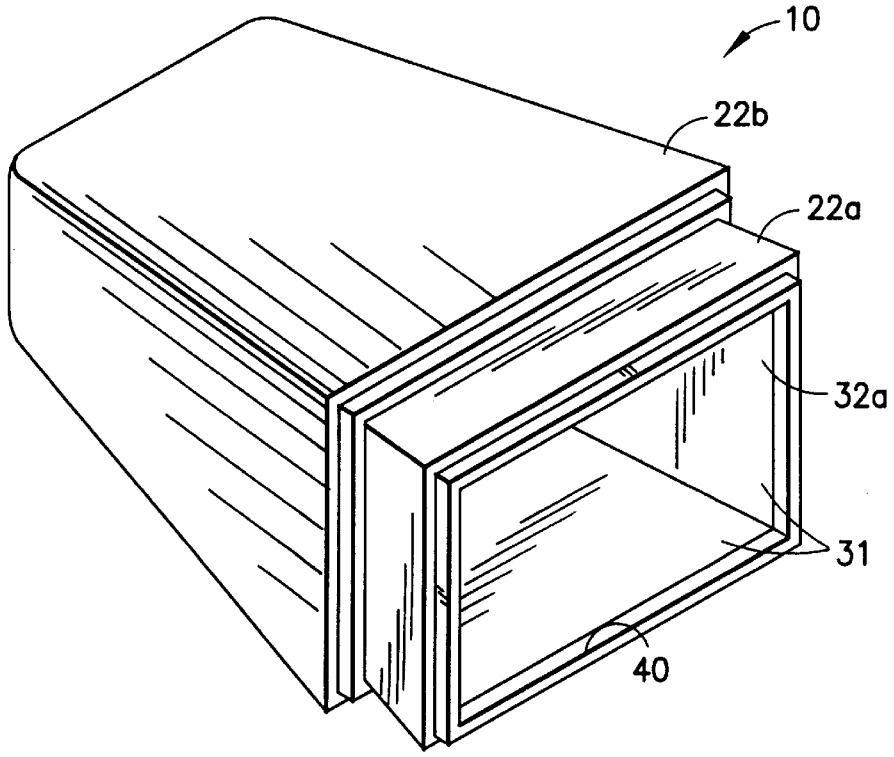
FIG. 4 is a perspective view of a pair of nestable speaker open-front enclosures of speaker assemblies of the first embodiment nested according to the invention.
Figure 5A:
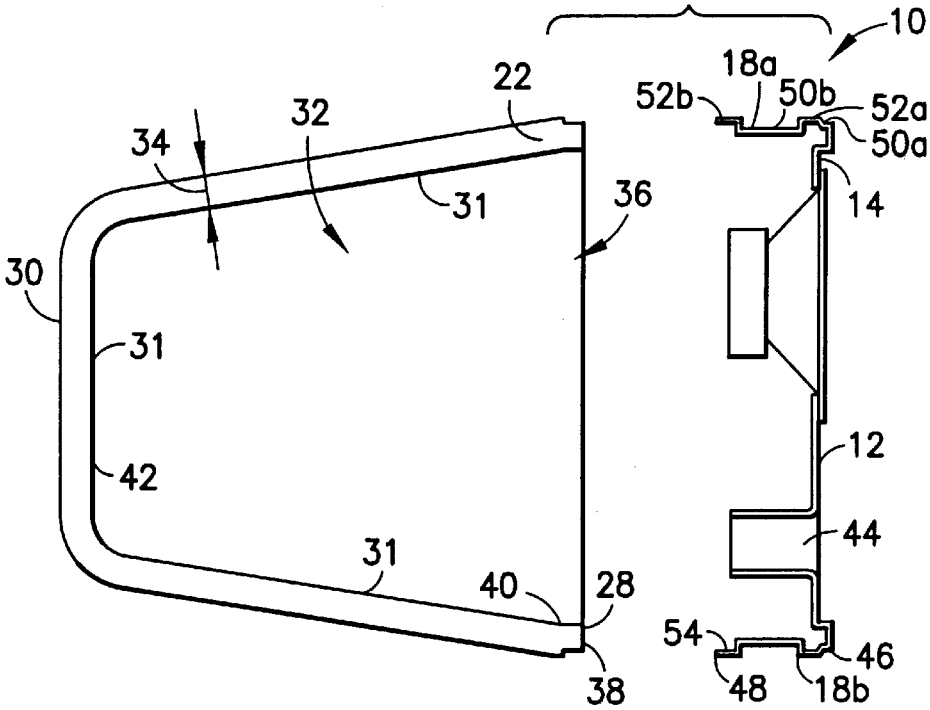
FIG. 5*a* is an exploded cross-sectional view taken along 5*a*—5*a* of FIG. 2.
Figure 5B:
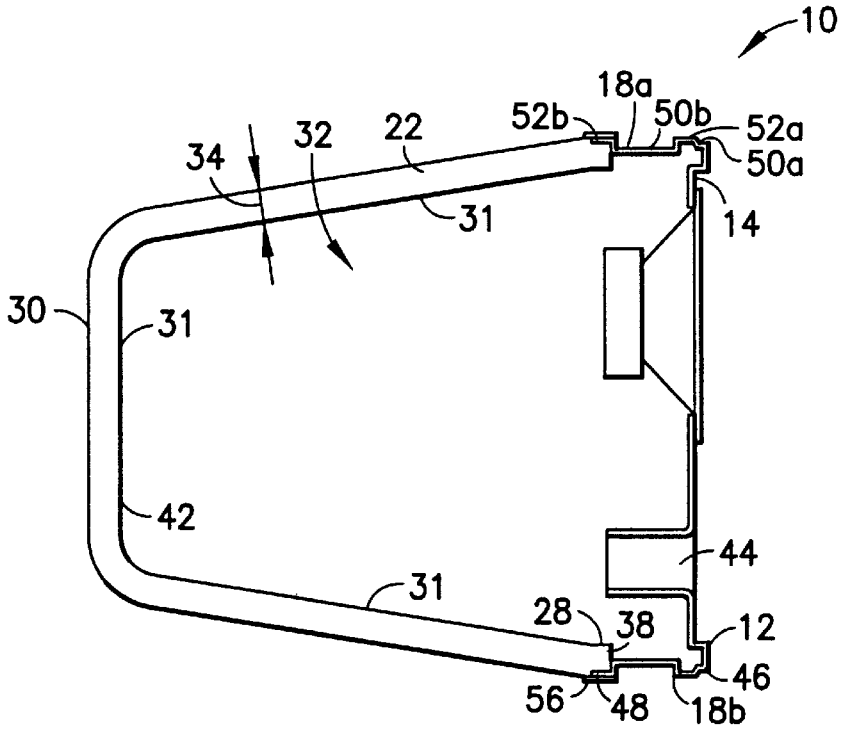
FIG. 5*b* is a cross-sectional view of the first embodiment of the single speaker assembly of FIG. 5*a* assembled according to the invention.

For the purpose of clarity, one of the plurality of speaker assemblies will now be described in detail with the understanding that all others are substantially identical and have associated elements with the same reference numerals. Referring now to FIGS. 2, 5*a*, and 5*b*, according to the first preferred embodiment of the invention, the hollow open-front enclosure 22 is preferably shaped as a truncated polyhedron (i.e., a truncated pyramid) having a first end 28 and a second end 30 and interior walls 31 defining a cavity 32 between the first end 28 and second end 30. Width and length dimensions at the first end 28 of the open-front enclosure 22 are preferably greater than width and length dimensions at the second end 30, i.e., the open-front enclosure 22 tapers in both length and width from the first end 28 to the second end 30. The open-front enclosure 22 has a substantially consistent thickness 34 throughout of between 0.125 inches and 0.75 inches. The first end 28 of the open-front enclosure 22 defines an opening 36 into the cavity 32, and is preferably provided with a lip 38 projecting forward of and substantially surrounding the opening 36. The second end 30 of the open-front enclosure 22 is substantially closed but may define a rear sound port (not shown) opening into the cavity 32. Like the open-front enclosure 22, the cavity 32 has a first end 40, a second end 42, and a depth measured between the first end 40 and the second end 42. Referring to FIGS. 3 and 4, according to a first preferred aspect of the invention, the interior walls 31 of the open-front enclosure 22 defining the cavity 32 taper from the first end 40 to the second end 42 (substantially conforming to the shape of the open-front enclosure) such that a first open-front enclosure 22*a* nests within a cavity 32*b* of a second open-front enclosure 22*b*.

Referring again to FIGS. 2, 5*a*, and 5*b*, according to the first preferred embodiment of the invention, preferable dimensions of the first end 28 of the open-front enclosure 22 are: between ten and sixty inches in length, and ten and sixty inches in width. Preferable dimensions of the second end 30 of the open-front enclosure 22 are: between eight and fifty-five inches in length, and eight and fifty-five inches in width. The open-front enclosure 22 is preferably between 0.125 and 0.75 inches thick and between five and forty inches in depth.

As-shown in FIGS. 2, 5*a*, and 5*b*, the face 14 of the speaker mounting element 12 preferably has similar dimensions as the first end 28 of the open-front enclosure 22 and may additionally define a front sound port 44 therethrough. The speaker mounting element 12, which is preferably formed from a rigid material such as ABS, polyethylene, fiberglass, or wood, has two pair of opposing sides 18*a*, 18*b* and 18*c*, 18*d*, each having a forward end 46 and a terminal end 48. The sides 18*a*–18*d* substantially define a depth of the speaker mounting element 12. According to the preferred embodiment of the invention, the sides 18*a*–18*d* of the speaker mounting element are preferably formed having alternating raised portions and recessed portions along their length from the forward ends 46 to the terminal ends 48. According to the preferred embodiment of the invention, beginning at the forward end 46 of the sides 18*a*–18*d* of the speaker mounting element 12, a first recessed portion 50*a* transitions to a first raised portion 52*a*; the first raised portion 52*a* transitions to a second recessed portion 50*b*; and finally, the second recessed portion 50*b* transitions to a second raised portion 52*b* terminating at the terminal end 48.

As shown specifically in FIGS. 2, 5*a*, and 5*b*, according to the first preferred embodiment of the invention 10, the lip 38 provided on the first end 28 of the open-front enclosure 22 corresponds to and is adapted to engage the inner face 54 of the second raised portion 52*b* of the sides 18*a*–18*d* of the speaker mounting element 12. A strap, belt, elastic ring, tie or other securing device 56 is secured about the second raised portion 52*b* of the structure 10 to apply an inward pressure or force which more securely couples the speaker mounting element 12 to the open-front enclosure 22.

Figure 6:
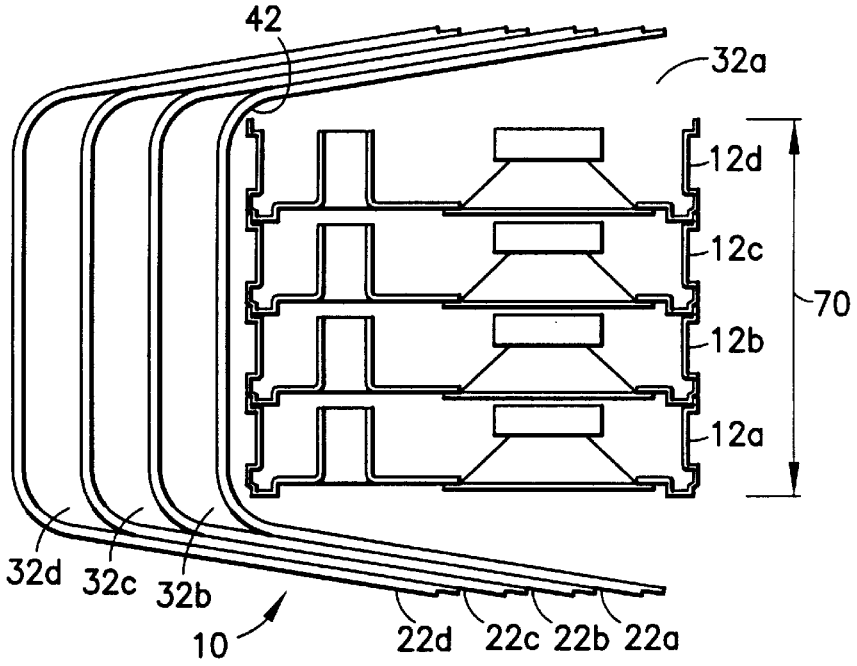
FIG. 6 is a cross-sectional view of the plurality of nestable speaker assemblies of the first embodiment disassembled and nested according to the invention.

Referring to FIG. 6, according to a first preferred aspect of the invention 10, the plurality of speaker mounting elements 12*a*–12*d* are adapted to be stored within the cavity 32*a*–32*d* of one of the plurality of open-front enclosures 22*a*–22*d*. To that end, either the widths of the open-front enclosures 22*a*–22*d* are greater than the lengths or vice versa; i.e., a cross section through the cavity of an open-front enclosure is generally rectangular. Further, the depths of the cavities 32*a*–32*d* (and therefore the open-front enclosures 22*a*–22*d*) are preferably larger than the greater of the length and width dimensions of the speaker mounting elements 12*a*–12*d*. The disparity of the dimensions facilitates storing speaker mounting elements 12*a*–12*d* within cavity 32*a* of open-front enclosure 22*a*. Still further, in order to safely store speaker mounting elements 12*a*–12*d* within cavity 32*a* of open-front enclosure 22*a*, it is preferable that at least one of the dimensions of the second end 42 of cavity 32*a* is greater than a cumulative size depth 70 of speaker mounting elements 12*a*–12*d* such that the plurality of speaker mounting elements 12*a*–12*d* fit within cavity 32*a* when grouped together.

Figure 7:
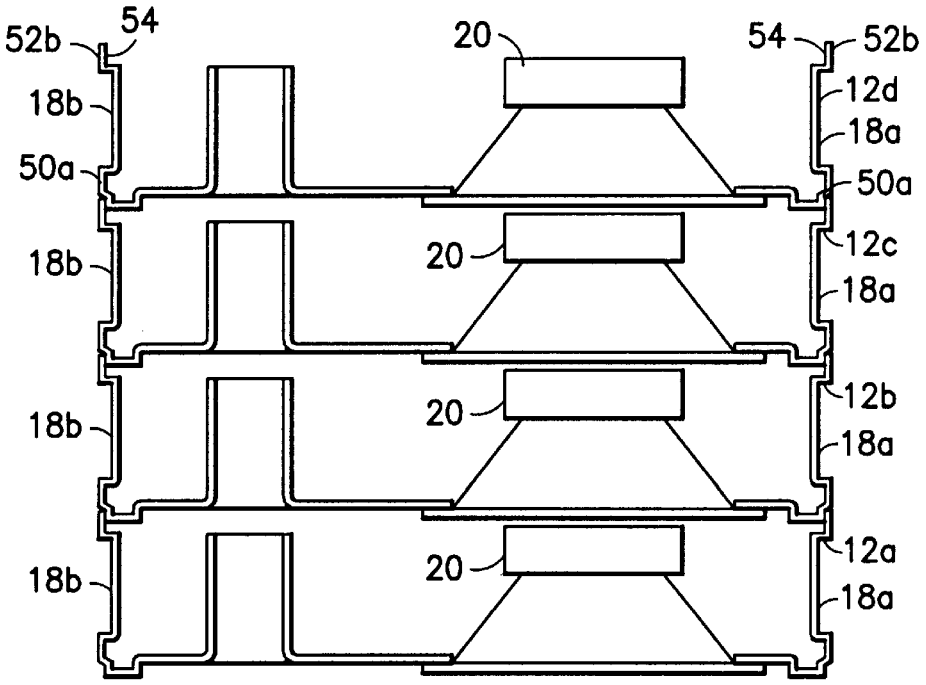
FIG. 7 is a cross-sectional view of a second preferred aspect of the speaker mounting elements according to the invention.

According to a second preferred aspect of the invention shown in FIG. 7, the plurality of speaker mounting elements 12*a*–12*d* are adapted to be stacked prior to storing them within a cavity of the nested open-front enclosures. To that end, the inner face 54 of the second raised portion 52*b* engages the first recess 50*a* of the sides 18*a*–18*d* of the speaker mounting elements 12*a*–12*d*. This allows the plurality of speaker mounting elements 12*a*–12*d* to be safely stacked in a front to rear relation without damaging speaker drivers 20 contained therein.

Figure 8:
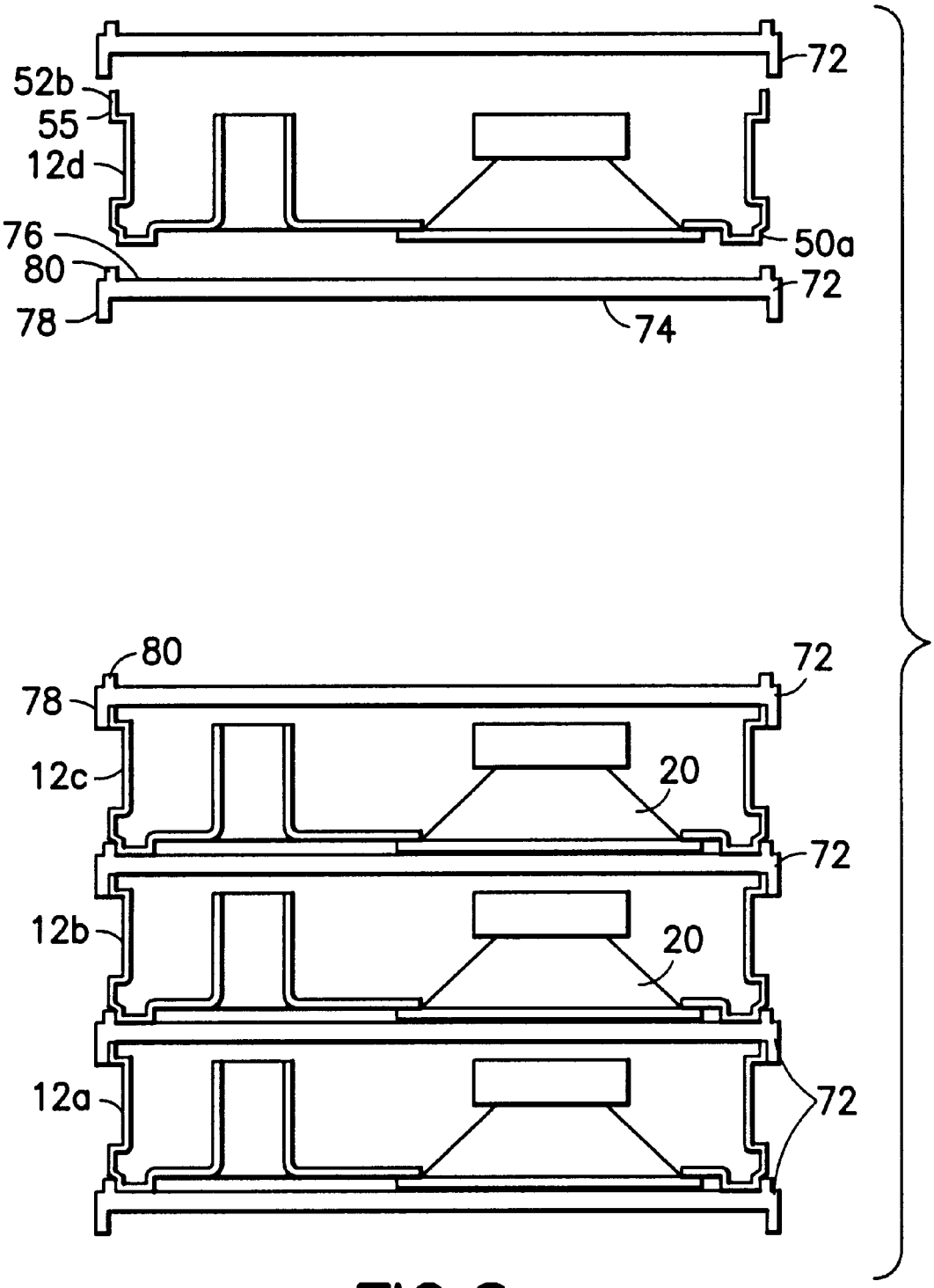
FIG. 8 is a partially exploded cross-sectional view of a first alternate second preferred aspect of the speaker mounting elements according to the invention.

Alternately or additionally, according to the second preferred aspect shown in FIG. 8, protective caps 72 may be provided to prevent damage to the speaker drivers 20 when the speaker mounting elements 12*a*–12*d* are stacked. The caps 72, which are preferably formed from plastic, preferably have a first face 74 and a second face 76. The first face 74 is provided with first nubs or ribs 78 which are adapted to fit over an outer face 55 of the second raised portions 52*b* of elements 12*a*–12*d*. The second face 76 is provided with second nubs or ribs 80 which are adapted to engage the first recessed portion 50*a* of elements 12*a*–12*d*. In this manner, the caps 72 protect both the front and the back of the speaker drivers 20 mounted to the speaker mounting elements 12*a*–12*d* and maintain the speaker mounting elements 12*a*–12*d* in a front to back relation.

Figure 9:
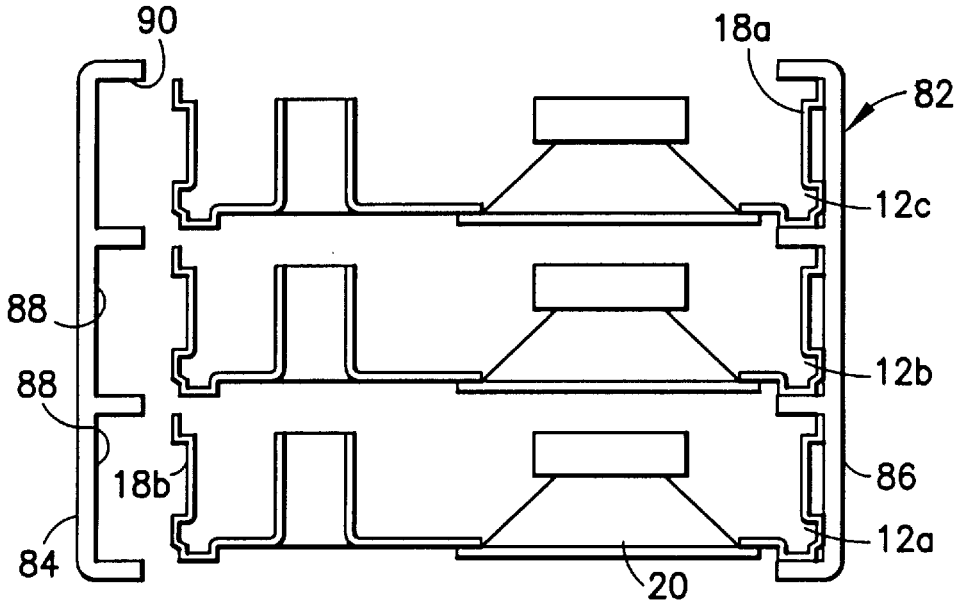
FIG. 9 is a partially exploded cross-sectional view of a second alternate second preferred aspect of the speaker assemblies according to the invention.

Alternatively, as shown in FIG. 9, according to the second preferred aspect, a stacking structure 82 is provided. The stacking structure 82 has a first piece 84 and a second piece 86 adapted to substantially fit around and engage opposing sides 18*a*, 18*b* or 18*c*, 18*d* of a plurality of speaker mounting elements 12*a*–12*c* maintaining them a distance apart in a front to back relation. The stacking structure 82 is used to stack the speaker mounting elements 12*a*–12*c* and protect the speaker drivers 20. The stacking structure 82 is preferably formed from expanded foam or plastic. Both the first piece 84 and the second piece 86 define a plurality of channels 88 along an interior side 90 of the structure 82 which are sized to receive and frictionally engage the opposing sides 18*a*, 18*b* or 18*c*, 18*d* respectively of the speaker mounting elements 12*a*–12*c*. A plurality of speaker mounting elements 12*a*–12*c* are positioned within the channels 88 between the first piece 84 and the second piece 86 of one stacking structure 82. The stacking structure 82 containing the stacked speaker mounting elements 12*a*–12*c* can then be safely stored within a cavity of an open-front enclosure or elsewhere.

Figure 10:
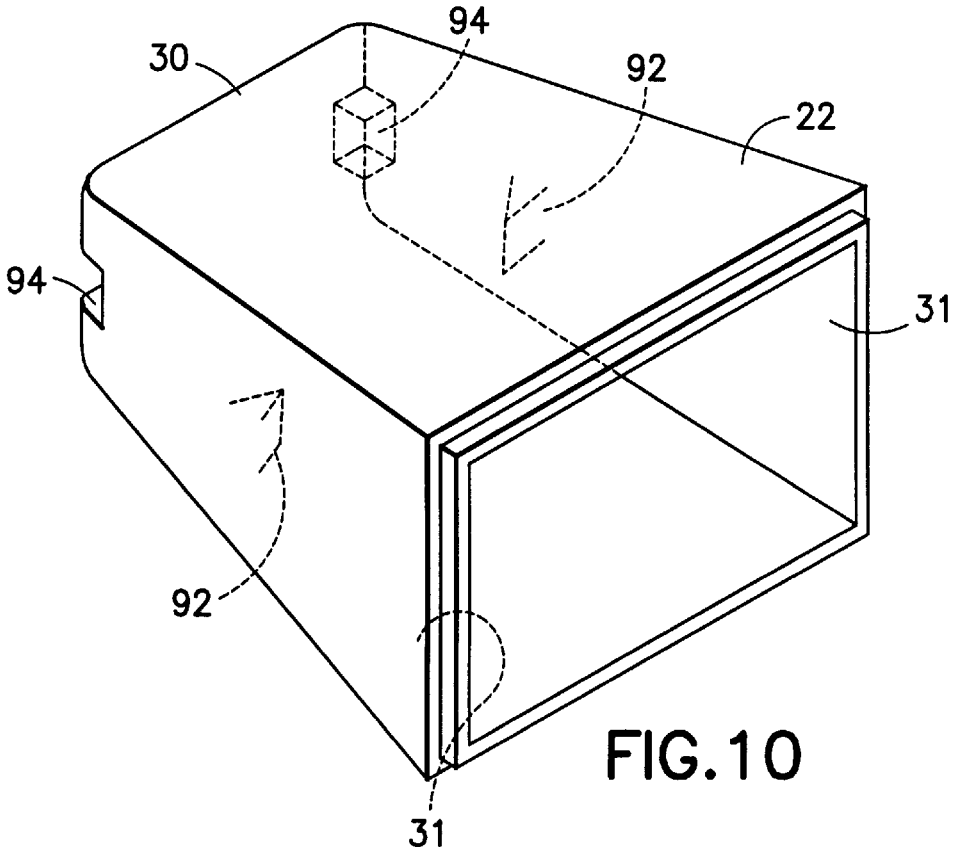
FIG. 10 is a perspective view of a third preferred aspect of the invention.

According to a third preferred aspect of the invention as shown in FIG. 10, stops 92 may be formed along interior walls 31 of the open-front enclosure 22, and correspondingly shaped notches 94 are formed into the second ends 30 of the open-front enclosures 22. With the notches 94 and stops 92, the second end of one nested open-front enclosure will be stopped from wedging into the cavity of another open-front enclosure such that the open-front enclosures must be damaged in order to be separated.

Figure 11A:
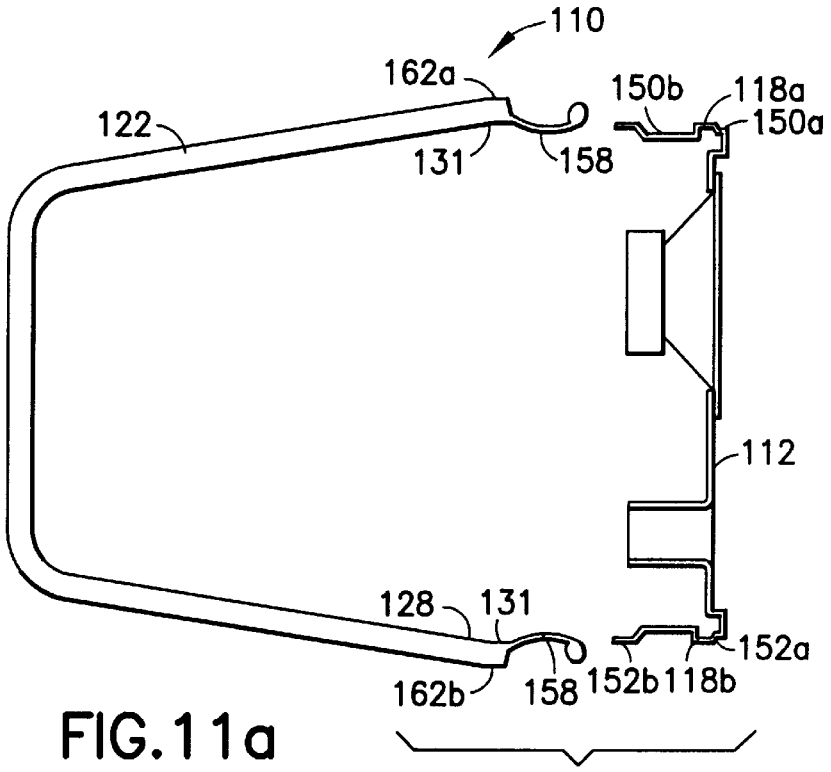
FIG. 11*a* is an exploded cross-sectional view of a second embodiment of a single speaker assembly according to the invention.
Figure 11B:
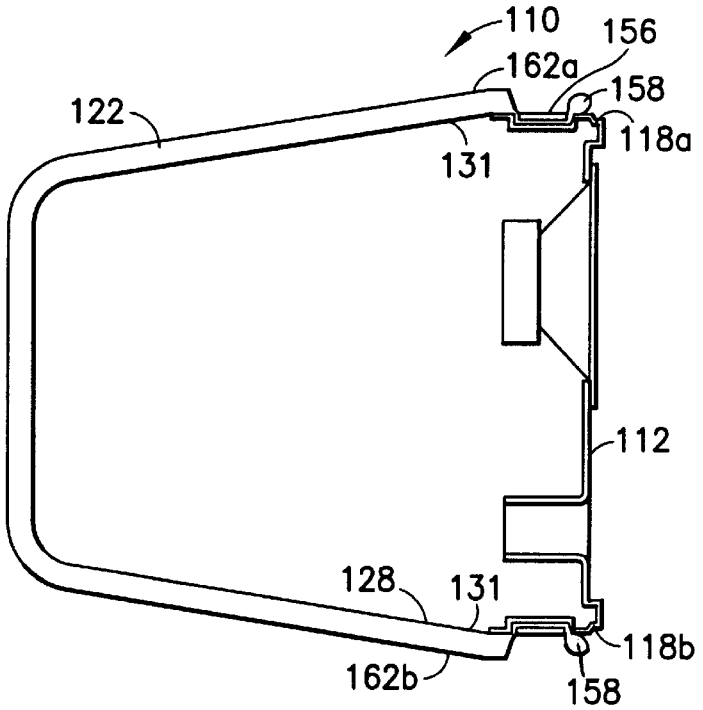
FIG. 11*b* is a cross-sectional view of the second embodiment of the single speaker assembly of FIG. 11*a* assembled according to the invention.
Figure 12:
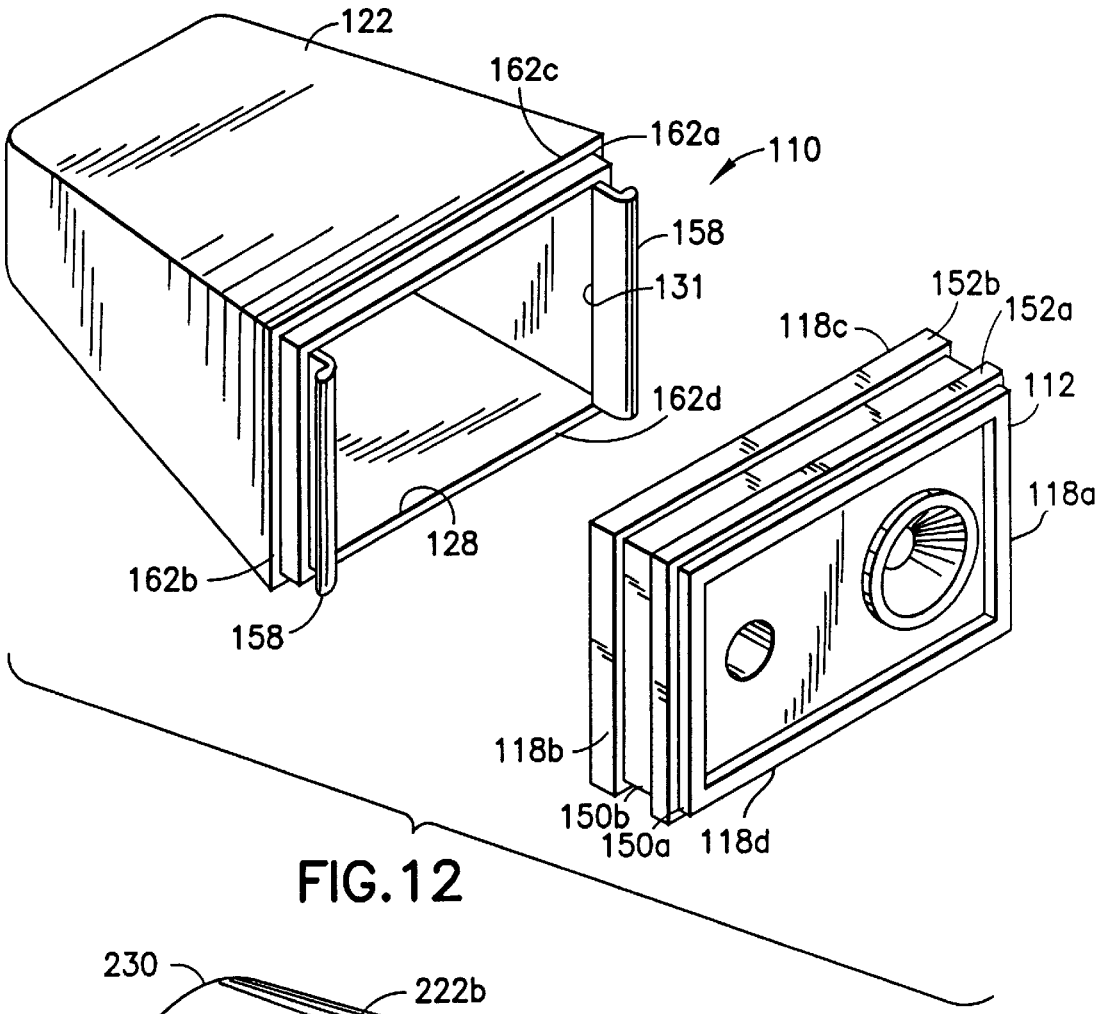
FIG. 12 is an exploded perspective view of a second embodiment of the speaker assembly according to the invention.

Referring to FIGS. 11*a*, 11*b*, and 12, according to a second preferred embodiment of the invention 110, which is substantially similar to the first embodiment 10 with like parts numbered similarly incremented by 100, forwardly protruding flexible arms 158 are provided on the interior wall 131 of either of the pair of opposing sides 162*a*, 162*b* and 162*c*, 162*d* of the first end 128 of the open-front enclosure 122. The flexible arms 158 are preferably formed from a spring material and secured to the interior wall 131 of the open-front enclosure 122 by screws, rivets, epoxy or otherwise. Alternatively, where the open-front enclosure 122 is plastic, the flexible arms 158 may be an integral extension of the open-front enclosure 122. The speaker mounting element 112 is adapted to fit between the flexible arms 158 of the open-front enclosure 122. The alternating raised portions 152*a*, 152*b* and recessed portions 150*a*, 150*b* of the sides 118*a*–118*d* of the speaker mounting element 112 are adapted to be engaged by the flexible arms 158 coupling the open-front enclosure 122 and the speaker mounting element 112. The flexible arms 158 are temporarily flexed to slip over the second raised portion 152*b* and then released to snap and seat within the second recessed portion 150*b*. The benefit to this embodiment 110 is that no additional coupling device is required to secure the speaker mounting element 112 to the open-front enclosure 122; although a band 156 can be provided as shown in FIG. 11*b*. To disengage the speaker mounting element 112 from the open-front enclosure 122, the flexible arms 158 are flexed outward away from the sides 118*a*–118*d* thereby releasing the coupling with the speaker mounting element 112. Once disengaged, the flexible arms 158 are released and spring back to their original positions.

Figure 13:
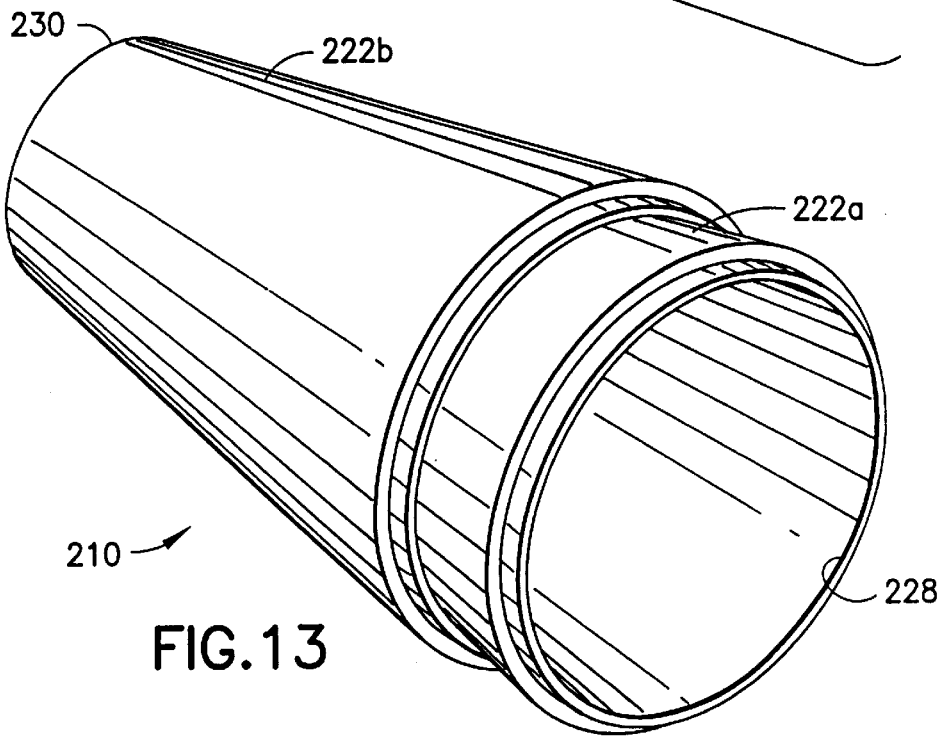
FIG. 13 is a perspective view of a third embodiment of nested speaker open-front enclosures according to the invention.

Referring now to FIG. 13, according to a third embodiment of the invention 210, which is substantially similar to the first embodiment 10 with like parts numbered similarly incremented by 200, the open-front enclosures 222*a*–222*b* may instead be formed in a shape (other than as previously shown), such as oval in cross-section, square in cross-section, triangular in cross-section, or frustro-conical (as shown) as long as they taper from a first end 228 to a second end 230. However, for open-front enclosures 222*a*, 222*b* having equivalent length and width dimensions at the first end 228, it will be appreciated that although it may be possible to nest the open-front enclosures 222*a*, 222*b*, it may not be possible to store a speaker mounting element within the cavity 232*a* of the open-front enclosure 222*a*.

There have been described and illustrated herein several embodiments of a nesting speaker enclosure assembly. While particular embodiments of the invention have been described, it is not intended that the invention be limited thereto, as it is intended that the invention be as broad in scope as the art will allow and that the specification be read likewise. Thus, while embodiments of a nesting speaker assembly having a particular shape and dimensions have been disclosed, it will be appreciated that other shaped configurations having different dimensions may be adapted for nesting as well so long as they have a generally tapering shape from a first end to a second end and the cavities have a similarly sized tapering shape as well. Further, in order to allow speaker mounting elements to be stored within a cavity of an open-front enclosure, ideal open-front enclosure opening dimensions further require that one dimension at each end of the opening be larger than another dimension at the same end and that the larger dimension be larger than a smaller of the two dimensions of the speaker mounting element. However, it will be appreciated that the difference in dimension is not necessary for nesting of the speaker open-front enclosures. Further, while it is preferable that the speaker mounting elements be stacked and then stored within a cavity of nested open-front enclosures, it will be appreciated that they need not be adapted to be stored within the open-front enclosures. Instead, alternate storage arrangements may be found for safely storing the speaker mounting elements. Further, while a particular number of speaker mounting elements have been shown stacked and stored within a cavity of an open-front enclosure, it will be appreciated that the open-front enclosure may be adapted to receive any number of stacked speaker mounting elements. Also, where the stacking structure is shown for stacking three speaker mounting elements, it will be understood that the stacking structure could be formed to hold any number of speaker mounting elements. Further, while particular materials have been disclosed for each of the elements of the speaker assembly, it will be appreciated that each of the elements could be formed from other materials as well. Also, while specific mechanisms for coupling the speaker mounting element and the open-front enclosure have been disclosed, it will be understood that other types of cooperating coupling structures including but not limited to a tongue and groove, overlapping lips, latch and clasp, or male/female friction fit coupling, may be used instead such that the two elements are detachably coupled. Also, while particular securing devices have been disclosed for maintaining the coupling between the speaker mounting element and open-front enclosure, it will be understood that other securing devices may be used instead including but not limited to: hook and loop tape, straps, brackets, clips, clamps, adhesives, friction fit coupling (inside or outside), flanges with screws, threaded or bayonet male/female couplings, or otherwise, such that the open-front enclosure and speaker mounting element can be separated for storage or to gain access to the rear of the speaker driver. Further, while particular devices and couplings for stacking the speaker mounting elements have been disclosed, it will be appreciated that other devices and couplings may likewise be used such that a plurality of the speaker mounting elements may be stacked without damaging speaker drivers contained thereon. Further, while particular uses for the speaker assemblies have been disclosed, it will be appreciated that it may be adapted for other uses as well, such as (by way of example and not by way of limitation) for portable computers, radios, and automobiles. It will therefore be appreciated by those skilled in the art that yet other modifications could be made to the provided invention without deviating from its spirit and scope as claimed.

What is claimed is:

1. A speaker assembly, comprising:

a) a first speaker; and b) a second speaker, substantially identical to said first speaker, said first and second speakers each including i) a speaker mounting element defining at least one speaker mounting opening, ii) at least one speaker driver coupled to said at least one speaker mounting opening of said speaker mounting element, and iii) an open-front enclosure having a first end and a second end, said open-front enclosure tapering from said first end to said second end, said open-front enclosure defining a cavity substantially between said first end and said second end, said first end defining an opening into said cavity, said cavity tapering substantially similar to said open-front enclosure, said speaker mounting element coupled to said open-front enclosure such that said speaker mounting element and said open-front enclosure substantially enclose said opening of said open-front enclosure forming a speaker enclosure, wherein said open-front enclosure of said first speaker substantially nests within said cavity of said a second of said second speaker.

2. A speaker assembly according to claim 1, wherein:

said speaker mounting elements of said first and second speakers each have a front face provided with at least one protrusion, a rear, and four sides extending rearward from said speaker mounting element substantially perpendicular to said front face, said sides of each speaker mounting element are adapted to receive said protrusions of said front face of another said speaker mounting element such that said speaker mounting elements are coupled in a front to rear relation.

3. A speaker assembly according to claim 2, wherein:

said speaker mounting elements are adapted to be stored within said cavity of said first of said open-front enclosures.

4. A speaker assembly according to claim 2, wherein:

said first ends of said open-front enclosures are provided with a lip projecting forward and substantially surrounding said openings, said sides of said speaker mounting elements are adapted to receive said lips.

5. A speaker assembly according to claim 4, further comprising:

iv) a securing means adapted to be secured about said open-front enclosure and said speaker mounting element.

6. A speaker assembly according to claim 2, wherein:

opposing sides of said first ends of said open-front enclosures are provided with flexible arms projecting forward and adapted to engage said sides of said speaker mounting elements.

7. A speaker assembly according to claim 2, further comprising:

c) a plurality of caps each having a front and a rear side, said front sides of said caps adapted to engage said sides of said speaker mounting elements, said rear sides of said caps adapted to engage said protrusions of said fronts of said speaker mounting elements, said caps adapted to protect said speaker drivers and to maintain said speaker mounting elements in a front to rear relation.

8. A speaker mounting assembly according to claim 2, further comprising:

c) a stacking structure, said stacking structure having a first piece and a second piece, said first and second pieces each defining a pair of spaced opposing channels, each of said pair of channels of said first piece corresponding to a first of said sides of one of said speaker mounting elements, each of said pair of channels of said second piece corresponding to an opposing side of said sides of said speaker mounting elements, said stacking structure adapted to maintain said speaker mounting elements in a front to rear relation.

9. A speaker assembly according to claim 1, wherein:

said open-front enclosures are detachably coupled to said speaker mounting elements.

10. A speaker assembly according to claim 9, wherein:

said first ends of said open-front enclosures are provided with a lip projecting forward and substantially surrounding said openings, said sides of said speaker mounting elements are adapted to receive said lips.

11. A speaker assembly according to claim 10, further comprising:

iv) a securing means adapted to be secured about said open-front enclosure and said speaker mounting element.

12. A speaker assembly according to claim 1, wherein:

opposing sides of said first ends of said open-front enclosures are provided with flexible arms projecting forward and adapted to engage said sides of said speaker mounting elements.

13. A speaker assembly according to claim 1, wherein:

at least one of said speaker mounting elements defines a sound port opening into said cavity.

14. A speaker assembly according to claim 1, wherein:

at least one of said open-front enclosures defines a sound port opening into said cavity.

15. A speaker assembly according to claim 1, further comprising:

c) a third speaker; and d) a fourth speaker, said third and fourth speakers substantially similar to said first and second speakers.

16. A nestable speaker assembly, comprising:

a) a plurality of substantially identical speaker mounting elements each defining at least one speaker mounting opening;

b) a plurality of speaker drivers each coupled to one of said speaker mounting openings; and c) a plurality of substantially identical open-front enclosures each having a first end and a second end and each defining a cavity, said first ends defining an opening into said cavities, said plurality of open-front enclosures tapering from said first ends to said second ends, said cavities tapering substantially similarly to said open-front enclosures such that one of said plurality of open-front enclosures substantially nests within a cavity of another of said plurality of open-front enclosures;

said plurality of speaker mounting elements each stackable front to back, said cavity of at least one of said plurality of open-front enclosures adapted to store said plurality of stacked speaker mounting elements.

17. A speaker assembly according to claim 16, wherein:

said plurality of second speaker mounting elements each have a front face provided with at least one protrusion, a rear, and four sides extending rearward substantially perpendicular to said front face, said sides of said first speaker mounting element are adapted to receive said protrusions of said second speaker mounting element such that said first speaker mounting element and said second speaker mounting element are coupled in a front to rear relation forming a stacked plurality of speaker mounting elements, said plurality of stacked speaker mounting elements are adapted to be stored within a cavity of a last of said plurality of open-front enclosures.

18. A speaker assembly according to claim 16, further comprising:

d) a plurality of caps each having a front and a rear side, said front sides of said caps adapted to engage said sides of said speaker mounting elements, said rear sides of said caps adapted to engage said fronts of said speaker mounting elements, said caps adapted to protect said speaker drivers and to maintain said plurality of speaker mounting elements a distance apart in a front to rear relation forming a stacked plurality of speaker mounting elements, said stacked plurality of speaker mounting elements are adapted to be stored within a cavity of a last of said plurality of open-front enclosure.

19. A speaker mounting assembly according to claim 16, further comprising:

d) a stacking structure, said stacking structure having a first piece and a second piece, said first and second pieces each defining a plurality of spaced opposing channels, each of said plurality of channels in said first piece corresponding to a first side of one of said plurality of speaker mounting elements, each of said plurality of channels in said second piece corresponding to an opposing side of each of said plurality of speaker mounting elements, said stacking structure adapted to be stored within a cavity of a last of said plurality of open-front enclosures.

20. A speaker assembly according to claim 16, wherein:

at least one of said plurality of speaker mounting elements defines a sound port between an exterior of said speaker assembly and said cavity.

21. A speaker assembly according to claim 16, wherein:

at least one of said plurality of open-front enclosures defines a sound port between an exterior of said speaker assembly and said cavity.

22. A method of storing a first and a second speaker assembly, each of said first and second speaker assemblies having a speaker mounting element defining a speaker mounting opening, a speaker driver coupled to the speaker mounting opening, and a substantially hollow open-front enclosure defining a cavity and having an opening into the cavity, said method comprising the steps of:

a) arranging a first open-front enclosure defining a cavity and having an opening into said cavity within a cavity defined within a second open-front enclosure;

b) stacking a first speaker mounting element onto a second speaker mounting element in a front to rear relation; and c) storing said stacked speaker mounting elements within a cavity of said first open-front enclosure.

23. A method according to claim 22, further comprising the step of:

d) prior to stacking said first and second speaker mounting elements, coupling a cap between said first speaker mounting element and said second speaker mounting element.

24. A method of assembling and disassembling a plurality of nested speaker assemblies, each having a speaker mounting element defining a speaker mounting opening, a speaker driver coupled to the speaker mounting opening, and a substantially hollow open-front enclosure defining a cavity and having an opening into the cavity, said method comprising the steps of:

a) removing a first open-front enclosure from within a nested plurality of open-front enclosures; and b) coupling a first speaker mounting element to said first open-front enclosure forming a first speaker enclosure.

25. A method according to claim 24, further comprising the step of:

c) repeating steps a) and b) until all of said plurality of open-front enclosures are coupled with a speaker mounting element.

26. A method according to claim 24, further comprising the step of:

c) prior to removing a first open-front enclosure from within the nested plurality of open-front enclosures, removing the plurality of stacked speaker mounting elements from within a cavity of said first open-front enclosure.

27. A method according to claim 24, further comprising the step of:

c) utilizing a first speaker driver coupled to said first speaker mounting element to make music with said first open-front enclosure coupled to said first speaker mounting element;

d) detaching said first speaker mounting element from said first open-front enclosure;

e) nesting said first open-front enclosure within a cavity of a second of said plurality of open-front enclosures;

f) stacking said first speaker mounting element in a front to rear relation to another of said plurality of speaker mounting elements; and g) storing said stacked plurality of speaker mounting elements within a cavity of said first open-front enclosure.

* * * * *